US007207199B2

(12) United States Patent
Smith et al.

(10) Patent No.: US 7,207,199 B2
(45) Date of Patent: Apr. 24, 2007

(54) DEAD LOCKING DEADBOLT

(75) Inventors: Jerry Smith, Littleton, CO (US); Mike Enslow, Milwaukee, WI (US)

(73) Assignee: Master Lock Company. LLC, Oak Creek, WI (US)

( * ) Notice: Subject to any disclaimer, the term of this patent is extended or adjusted under 35 U.S.C. 154(b) by 37 days.

(21) Appl. No.: 10/711,058

(22) Filed: Aug. 19, 2004

(65) Prior Publication Data

US 2005/0039504 A1 Feb. 24, 2005

Related U.S. Application Data

(60) Provisional application No. 60/481,268, filed on Aug. 20, 2003.

(51) Int. Cl.
*E05B 65/06* (2006.01)

(52) U.S. Cl. ..... 70/134; 70/152; 70/416; 70/432; 70/467; 70/482; 70/483; 292/150; 292/336.3; 292/359

(58) Field of Classification Search ..... 70/416, 70/417, 468, 471, 481–483, 487, 152, 153, 70/188, 189, 432, 438, 223, DIG. 59, DIG. 73; 292/359, DIG. 24, 336.3, 150, 347
See application file for complete search history.

(56) References Cited

U.S. PATENT DOCUMENTS

| | | | | |
|---|---|---|---|---|
| 588,673 | A * | 8/1897 | Wyman | 292/359 |
| 856,558 | A * | 6/1907 | Voight | 292/359 |
| 861,421 | A * | 7/1907 | Young | 70/379 R |
| 1,362,417 | A | 12/1920 | Hammer | |
| 1,783,785 | A * | 12/1930 | Habicht | 292/359 |
| 2,289,129 | A | 7/1942 | LaLonde | |
| 2,297,711 | A | 10/1942 | LaLonde | |

(Continued)

FOREIGN PATENT DOCUMENTS

| | | |
|---|---|---|
| TW | 0250139 | 8/1983 |

(Continued)

*Primary Examiner*—Lloyd A. Gall
(74) *Attorney, Agent, or Firm*—Calfee Halter & Griswold

(57) ABSTRACT

A deadbolt mechanism including a lock out mechanism that functions to disable the operation of the deadbolt from at least one side of the deadbolt mechanism. The deadbolt mechanism includes a deadbolt, key cylinder, housing, turn knob and a shaft that connects the key cylinder and turn knob. To place the deadbolt mechanism in lock out mode, the turn knob is moved to the locked positioned and then pulled outward away from the door. By pulling the knob outward, the shaft engages a portion of the housing which prevents rotation of the shaft and thereby prevents movement of the deadbolt from the locked position.

24 Claims, 7 Drawing Sheets

U.S. PATENT DOCUMENTS

| | | | | | |
|---|---|---|---|---|---|
| 2,435,634 | A | | 2/1948 | Nicolin et al. | |
| 2,481,099 | A | | 9/1949 | Formo et al. | |
| 2,497,329 | A | | 2/1950 | Smith et al. | |
| 2,525,340 | A | * | 10/1950 | Clark | 292/359 |
| 3,299,678 | A | * | 1/1967 | Spencer | 70/208 |
| 3,600,916 | A | * | 8/1971 | Ruppert | 70/432 |
| 3,869,901 | A | * | 3/1975 | Neary | 70/432 |
| 4,055,361 | A | * | 10/1977 | Moses | 292/359 |
| 4,709,566 | A | | 12/1987 | Wildenradt | |
| 4,979,383 | A | | 12/1990 | Tully | |
| 5,058,940 | A | | 10/1991 | Hart | |
| 5,072,976 | A | | 12/1991 | Meszaros | |
| 5,072,978 | A | * | 12/1991 | Woodward | 292/359 |
| 5,087,090 | A | | 2/1992 | Humphrey et al. | |
| 5,421,074 | A | | 6/1995 | Moore | |
| 5,657,653 | A | | 8/1997 | Hensley et al. | |
| 5,934,122 | A | | 8/1999 | Edwards et al. | |
| 6,708,538 | B1 | | 3/2004 | Walby | |
| 2006/0042336 | A1 | * | 3/2006 | Smith et al. | 70/432 |

FOREIGN PATENT DOCUMENTS

| | | | |
|---|---|---|---|
| TW | 0291890 | | 6/1985 |
| TW | 0365285 | | 10/1987 |
| TW | 0550329 | B | 9/2003 |
| TW | 0580039 | Y | 3/2004 |
| WO | WO-8402157 | A1 | 6/1984 |

* cited by examiner

DEAD LOCKING DEADBOLT

CROSS REFERENCE TO RELATED APPLICATIONS

This application claims the benefit under 35 U.S.C. §119 (e) of U.S. Provisional Application Ser. No. 60/481,268 filed Aug. 20, 2003, the entire disclosure of which is hereby incorporated by reference.

BACKGROUND OF INVENTION

This invention relates to locking devices in general and "lock-out" devices for deadbolts in particular.

Bolts or deadbolts are well known devices for locking a door shut for security purposes. In such well-known arrangements, the deadbolt or bolt is mounted in the body of the door and the deadbolt is operated by mechanical operating devices mounted on either side of the door. When the deadbolt is operated to a locked position it typically extends or projects from the side of the door into an opening in the door jam or wall to which the door is mounted. Thus, the deadbolt when operated to an extended position, "bolts" or "locks" the door in a closed position. The mechanical operating devices also can operate to retract the bolt into the side of the door to unlock the deadbolt or bolt.

In typical arrangements, one mechanical device used to operate a deadbolt may be a key cylinder into which a key is inserted. The key then can rotate the cylinder which, in turn, operates the deadbolt through various mechanical linkages. Another mechanical device that may be used to operate a deadbolt includes a knob that can be turned manually that, in turn, operates the deadbolt through various mechanical linkages.

It is known to use a key cylinder and knob device together to operate deadbolts. The key cylinder is normally mounted on the exterior side of the door so that a user can use a unique key to operate and lock the deadbolt from the exterior side of the door. The manual knob is typically mounted on the interior of the door and operates the deadbolt from the interior side of the door without a key. Thus, the user can easily lock and unlock the deadbolt from the interior of the door without using or locating a key.

It is sometimes desirable for users to disable the mechanical device for operating the deadbolt that is mounted on the exterior of the door. This can occur in situations in which the user does not wish to permit a person with a key to operate the deadbolt from the exterior side of the door such as, for example, a landlord/tenant situation in which the tenant does not wish the landlord to enter a rental property. Another important use of this feature is to prevent unauthorized access through the manipulation of the deadbolt by lock "picks" or the like. Mechanisms that disable the operation of a mechanical device used to operate a deadbolt are called "lock-out" devices.

Known lock-out devices for deadbolts are unreliable, difficult and clumsy to use and have safety concerns in that they do not signal to a user when a "lock-out" mechanism is in operation.

SUMMARY OF INVENTION

The invention provides a lock-out device for a locking mechanism that is reliable and simple to use and, in some embodiments, signals to the user that the lock-out mechanism has been activated. The invention may be comprised of a shaft upon which a knob or handle is mounted that has openings or channels in the wall of the shaft. The openings in the shaft correspond to protrusions or protuberances in the shaft housing. To operate the lock-out device, when the knob is turned to the locked position in which the deadbolt is extended, the handle or knob may be pulled which pulls the openings in the shaft into interlocking engagement with the protrusions in the shaft housing. As a result, a mechanical member that operates the locking mechanism is restrained, thus "locking out" the deadbolt bolt mechanism. Thus, the deadbolt can not be operated by a key through a key cylinder mounted on the exterior side of the door effecting a "lock-out" condition. In some embodiments, when the shaft is pulled into a lock-out position, a portion of the shaft becomes visible from the interior-side of the door. In some embodiments the visible portion of the shaft includes an indicator or warning mechanism to signal to the user that the deadbolt is now in "lock-out" condition.

BRIEF DESCRIPTION OF DRAWINGS

In the accompanying drawings, which are incorporated in and constitute a part of this specification, embodiments of the invention are illustrated, which, together with a general description of the invention given above, and the detailed description given below serve to illustrate the principles of this invention. The drawings and detailed description are not intended to and do not limit the scope of the invention or the claims in any way. Instead, the drawings and detailed description only describe embodiments of the invention and other embodiments of the invention not described are encompassed by the claims.

DETAILED DESCRIPTION

Figure 1:
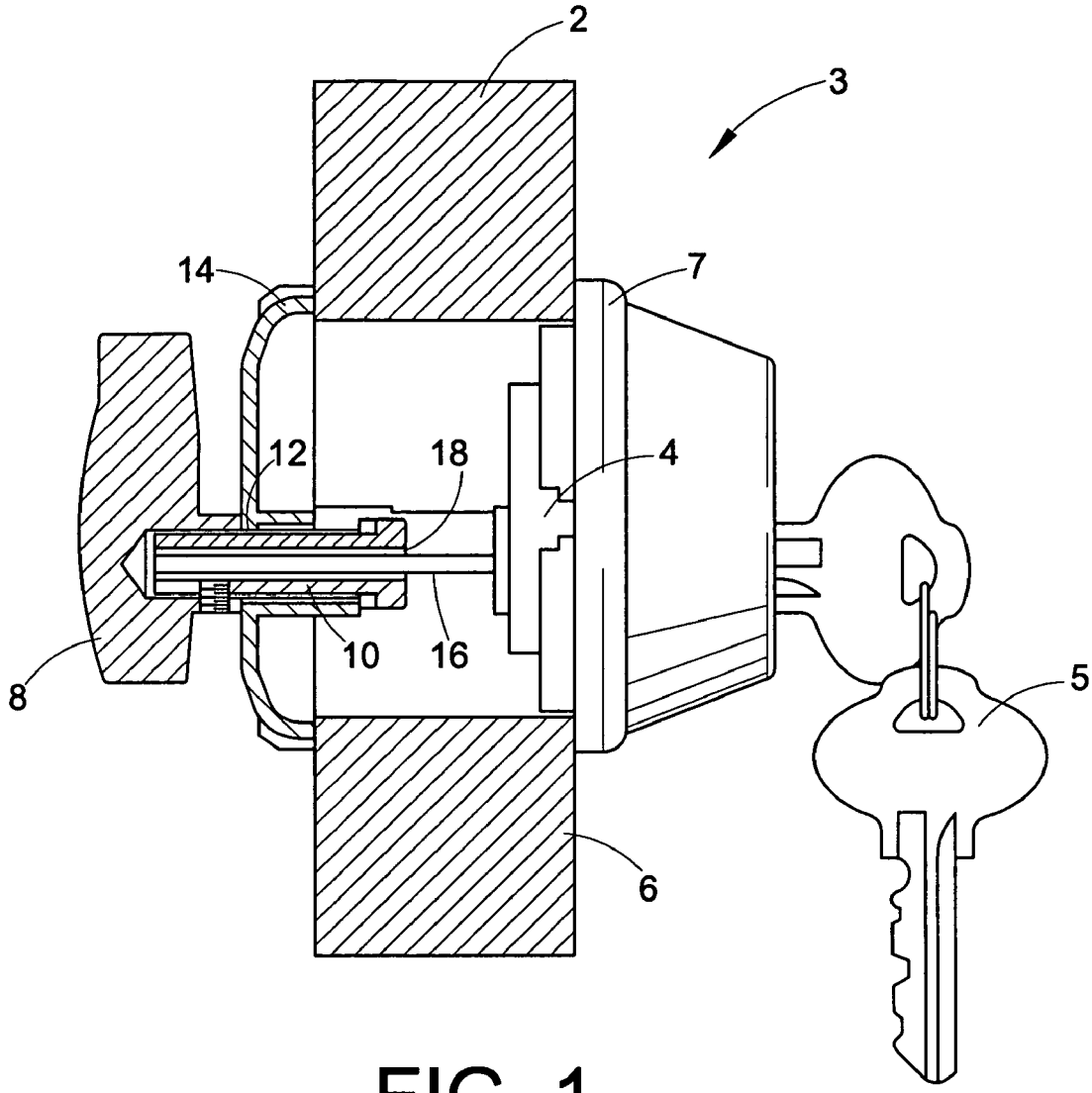
FIG. 1 is a partial cross-sectional view of the deadbolt lockout mechanism of the present invention.
Figure 2:
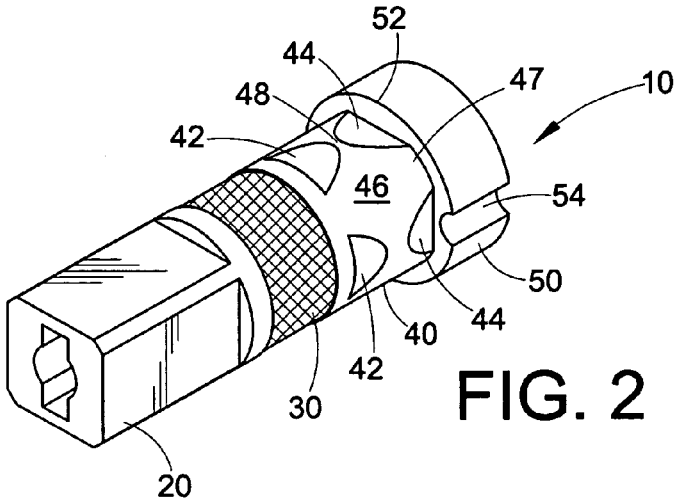
FIG. 2 is a perspective view of the shaft used in the deadbolt lockout mechanism of the present invention.
Figure 3:
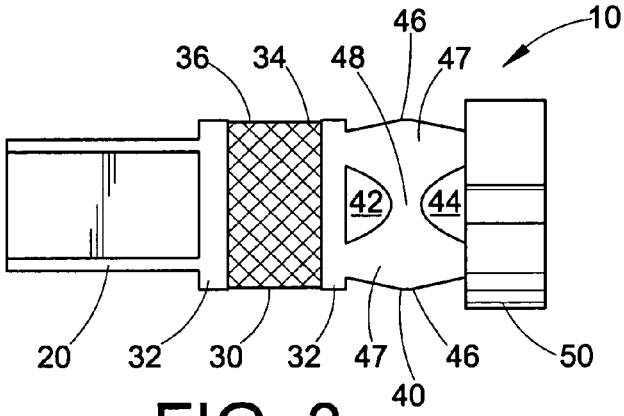
FIG. 3 is a side view of the shaft shown in FIG. 2.
Figure 4:
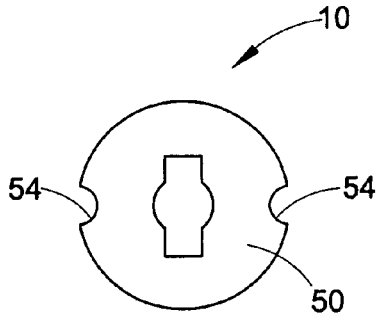
FIG. 4 in an end view of the shaft shown in FIG. 2.
Figure 5:
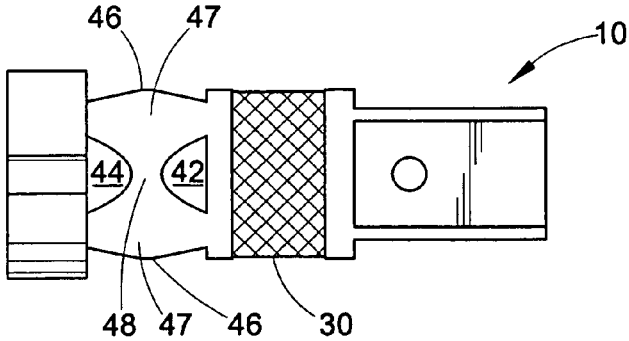
FIG. 5 is a side view of the shaft shown in FIG. 2, opposite from that shown in FIG. 3.
Figure 6:
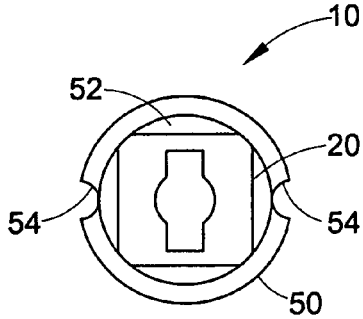
FIG. 6 is an end view of the shaft shown in FIG. 2, opposite from that shown in FIG. 4.

Referring now to FIG. 1, a door 2 including one embodiment of the invention is shown. As can be seen, a deadbolt manipulation mechanism, such as a conventional key cylinder 4 is mounted on one side of the door 2 which permits the deadbolt mechanism 3 to be operated by a key 5. The key cylinder 4 is normally mounted on the exterior side 6 of the door 2 in a protective housing 7. The "exterior-side" of a door is the side which is on the outside wall of a dwelling or building or any space desired to be "locked" from unauthorized entry. However, this invention is not limited to such a configuration and the key cylinder may be mounted on the interior or exterior side of the door. A second deadbolt manipulation mechanism, such as a knob or handle 8 also for operating the deadbolt is mounted on the side of the door opposite the key cylinder 4. The knob or handle 8 is mounted on a shaft 10 further described below. The shaft 10 is, in turn, mounted in an opening 12 in a shaft housing 14.

The key cylinder 4 includes an elongated member 16 sometimes called a "tailpiece" that may be generally rectangular in cross-section, or may be adapted for other configurations. The elongated member 16 is connected to the rear of the key cylinder 4. When the key cylinder 4 is rotated by key 5, member 16 is also rotated. Member 16 is then connected by known mechanical linkages to a bolt or deadbolt (not shown). When member 16 is rotated in one direction the deadbolt is extended into a locked position. When member 16 is rotated in the opposite direction, the deadbolt is retracted into the door 2 into an unlocked position. This type of locking and unlocking action for a deadbolt through a key cylinder 4 is known.

As can be seen in FIG. 1, shaft 10 is hollow in that it has a cavity 18 that extends along its entire length in a horizontal direction when shaft 10 is mounted in shaft housing 14. Member 16 extends from key cylinder 4 into cavity 18 of shaft 10. Thus, when knob 8 is rotated, shaft 10 rotates and then member 16 also rotates. Accordingly, the deadbolt can be operated through use of two different deadbolt manipulation mechanisms, such as handle 8 and key cylinder 4. Thus, both handle 8 and key cylinder 4 may be used to operate the same deadbolt through the rotation of member 16.

Referring now to FIGS. 2–6, shaft 10 is shown. Shaft 10 is comprised of four different subsections along its length. The first subsection is the knob mounting portion 20. Knob mounting portion 20 is generally rectangular or square in cross-section in one embodiment, but could be comprised of any cross-sectional shape. When shaft 10 is mounted in shaft housing 14, knob mounting portion 20 extends from the exterior of shaft housing 14. Knob 8 is then mounted on knob mounting portion 20 by fitting mounting portion 20 into a recess on knob 8. Knob 8 is then secured to mounting portion 20 through the use of known connective methods, such as, for example, a set screw.

The second portion of shaft 10 is signal portion 30. Signal portion 30 is circular in cross-section in one embodiment, but similar to mounting portion 20, its construction is not limited to any particular cross-sectional shape. Signal portion 30 has two boundary walls 32 that form a recessed area 34. An indication mechanism, such as, for example, a colored, circular plastic clip 36 is snap-fit around shaft 10 to fit into recessed area 34 between walls 32. An alternative indication mechanism is direct application of color to the signal portion 30 of the shaft 10. The indication mechanism can be of any color, but a visually distinct color typically used to give alerts or signals such as red, orange or yellow should be used. Alternatively, other indication mechanisms can be used, such as, for example, engravings, knurling, demarcations, recesses, or other physical marking or add on portion that would provide a visible indication to the user that the shaft 10 was pulled-out and the deadbolt mechanism 3 was in lockout position. Optionally, other indication mechanisms could be used, including electronic mechanisms or audible mechanisms.

The third portion of shaft 10 is camming portion 40. Camming portion 40 has a cross-section that is not typical in that it is comprised of several cam surfaces 42, 44 and 46. Camming portion 40 is essentially comprised of eight different sides. Four sides 47 of camming portion 40 are comprised of four camming surfaces 46. The other four sides 48 are each comprised of two camming surfaces 42 and 44. Sides 47 and sides 48 alternate around the circumference of camming portion 40.

The fourth subsection of shaft 10 is head portion 50. Head portion 50 is generally circular in cross-section in one embodiment, but is not limited in any way to any particular cross-sectional shape. Head portion 50 has a diameter or cross-sectional width that is greater than any of the other three shaft portions 20, 30, 40 such that a ridge or lip 52 is formed between head portion 50 and camming portion 40.

Head portion 50 has two grooves, openings or depressions 54 in its otherwise generally circular perimeter. These depressions 54 are on opposite sides of head portion 50 and are parallel to the horizontal axis of the shaft 10 when mounted in shaft housing 14. Depressions 54 need not be of any particular shape, but in the embodiment shown in FIGS. 2, 3 and 4 they are semi-circular in shape and form a groove-like depression. Depressions 54 could be located anywhere on head portion 50 in addition to the location shown in the embodiment depicted in FIGS. 2–6.

Figure 7:
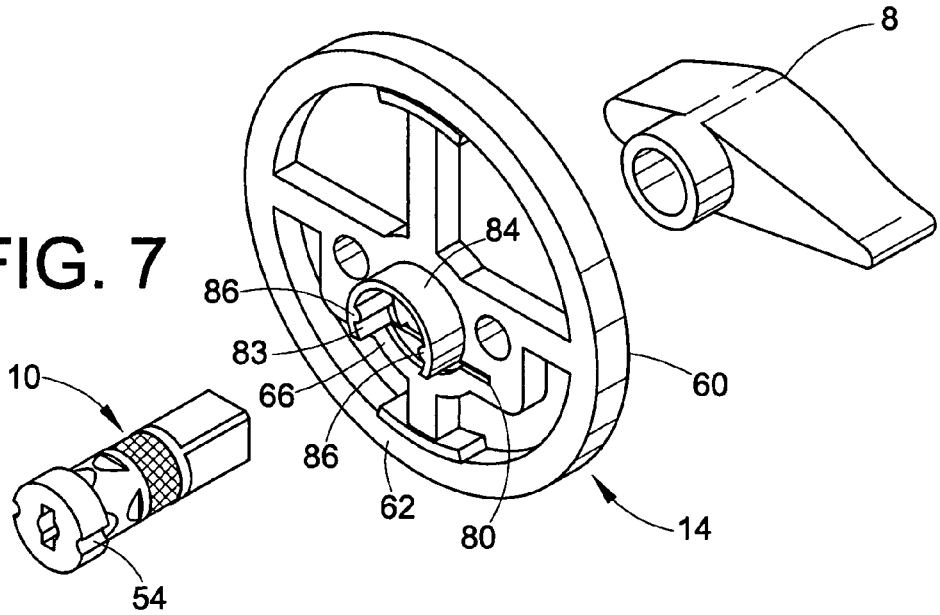
FIG. 7 is an exploded view of the shaft, mounting plate and knob subassembly of the deadbolt locking mechanism of the present invention.
Figure 8:
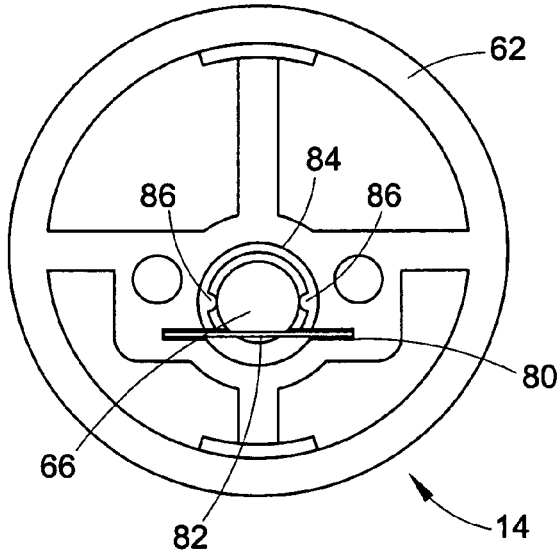
FIG. 8 is a plan view of the mounting plate shown in FIG. 7.
Figure 9:
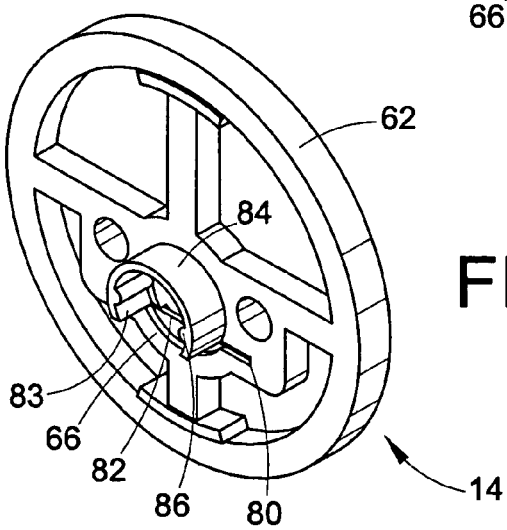
FIG. 9 is a perspective view of the mounting plate shown in FIG. 7.

Referring now to FIGS. 7–9 shaft housing 14 is described. Shaft housing 14 is comprised of an outer decorative plate 60 and a mounting plate 62. Both plates 60 and 62 have an opening 64 and 66, respectively, for accommodating shaft 10. Decorative plate 60 covers the exterior surface of mounting plate 62.

The interior or door facing side of mounting plate 62 includes a groove 80. Groove 80 holds a spring or detent device 82. Detent device 82 is a spring wire in the embodiment shown, but any type of known device that creates a spring, resilient or holding force can be used. The detent device 82 operates on cam surfaces 42 and 44 of shaft 10 as set forth below and serves to hold the shaft in, or urge it into, either a locked or unlocked position. The total shaft length can be of any dimension, but is preferably between 15 and 75 millimeters.

The mounting plate 62 also includes a collar 84 that extends from plate 62 around opening 66 except where biasing device 82 is located. In the embodiment shown in FIGS. 7–9, collar 84 is circular or semi-circular in shape, but any shape that corresponds to the shape of head portion 50 of shaft 10 can be used. Collar 84 also has two protrusions or protuberances 86 that extend from the inside walls 83 of collar 84. These protuberances 86 extend out from the wall of collar 84 approximately 2–3 millimeters to their tips and preferably can extend out from the inside walls of the collar anywhere from 1 millimeter to 2 centimeters. Protuberances 86 correspond to depressions 54 in shape and location, and, in this embodiment run parallel to the horizontal axis of shaft 10 when it is mounted in opening 66.

Figure 14:
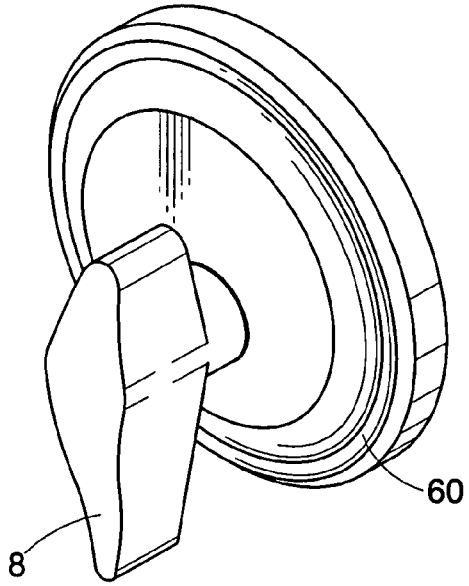
FIG. 14 is a front perspective view of the subassembly shown in FIG. 7 in the operational deadbolt position.
Figure 15:
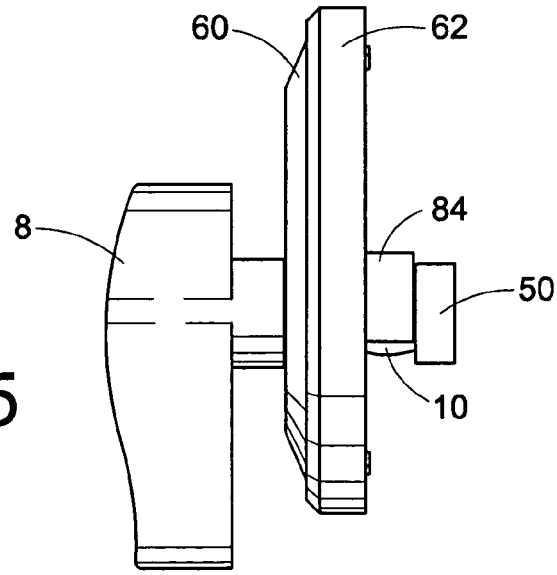
FIG. 15 is a side view of the subassembly shown in FIG. 7 in the operational deadbolt position.
Figure 16:
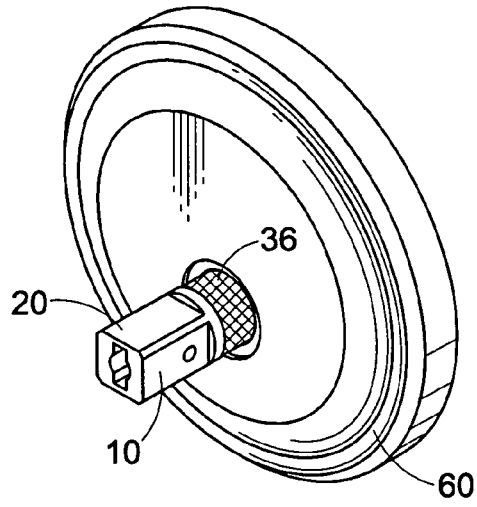
FIG. 16 is an assembly view of the mounting plate and shaft subassembly in the lockout position.
Figure 17:
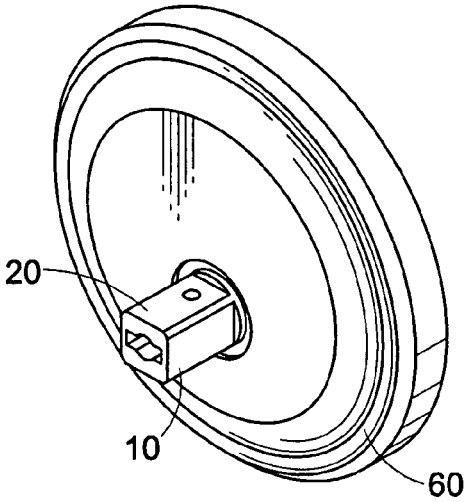
FIG. 17 is an assembly view of the mounting plate and shaft subassembly in the operational deadbolt position.
Figure 18:
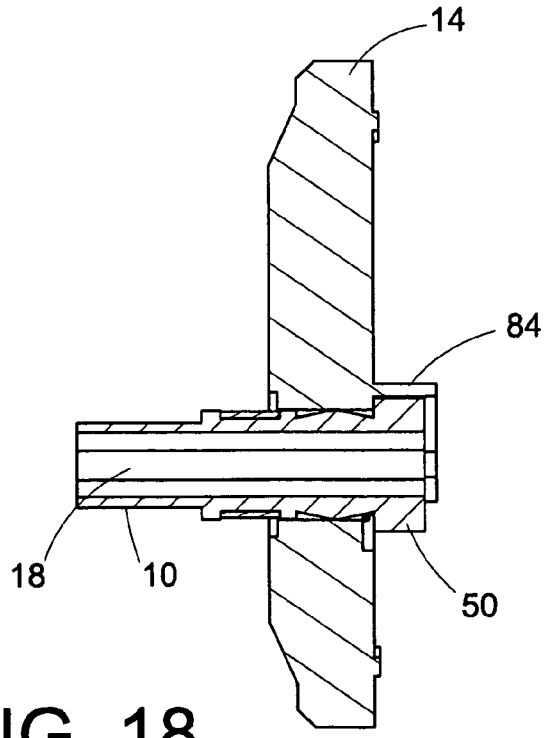
FIG. 18 is a cross-sectional view of the mounting plate and shaft subassembly in lockout position.

Now referring to FIGS. 10–18, the operation of one embodiment of the invention is described. As shown in FIG. 14, the deadbolt mechanism 3 is in an unlocked position. As can be seen, head portion 50 extends beyond collar 84. Thus, handle 8 can be rotated clockwise or counter clockwise to a locked position which would extend the deadbolt into a locked position. When handle 8 is rotated to the locked position, one of camming surfaces 46 operates against detent device 82 to "snap" the shaft 10 into the locked position.

Figure 10:
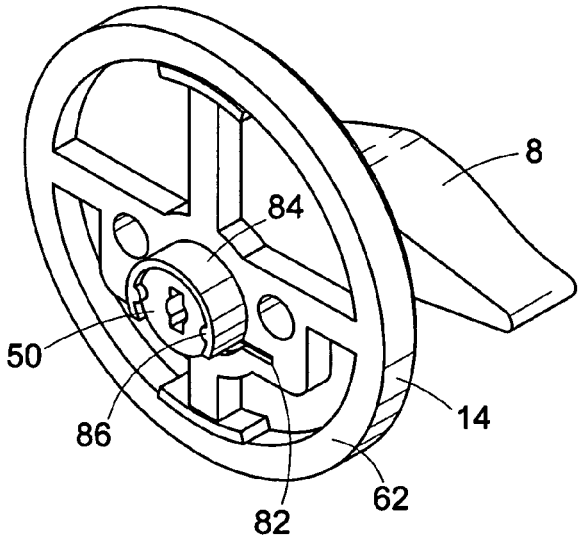
FIG. 10 is a rear perspective view of the subassembly shown in FIG. 7 in the lockout position.
Figure 11:
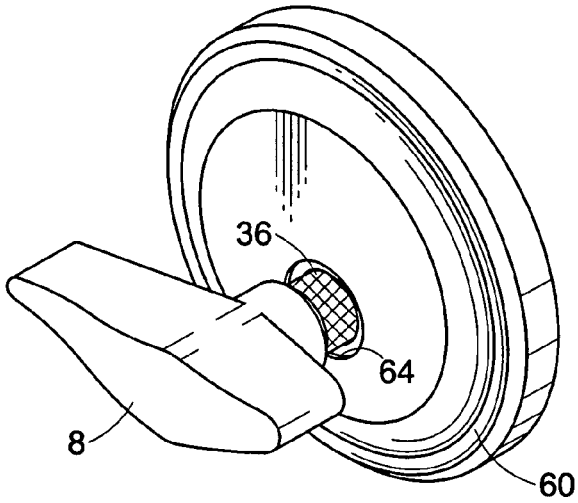
FIG. 11 is a front perspective view of the subassembly shown in FIG. 7 in the lockout position.
Figure 12:
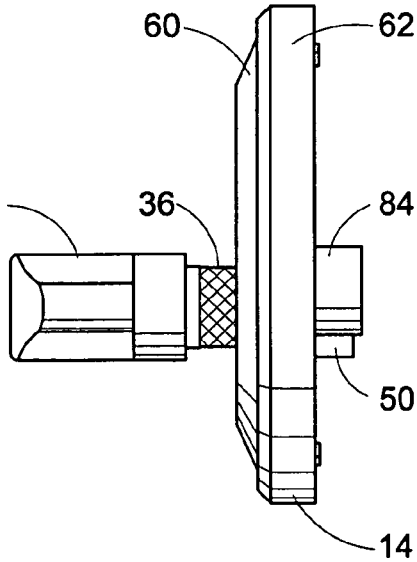
FIG. 12 is a side view of the subassembly shown in FIG. 7 in the lockout position.
Figure 13:
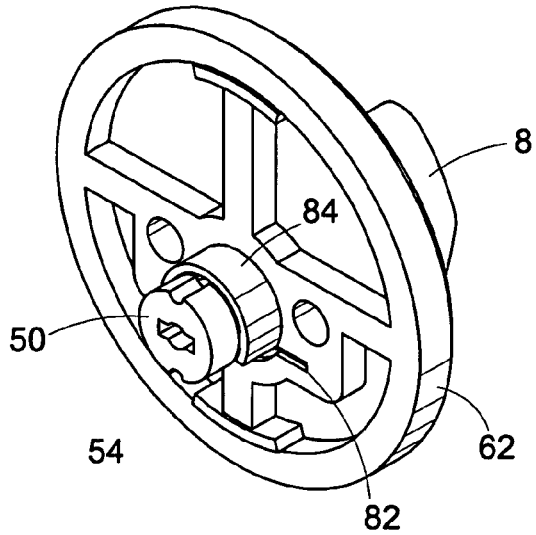
FIG. 13 is a rear perspective view of the subassembly shown in FIG. 7 in the operational deadbolt position.

Referring now to FIG. 10, the shaft 10 is shown in the locked position. As can be seen, the depressions 54 correspond to and are "keyed" to protuberances 86 in the locked position. In this position, the deadbolt is extended from the door into the locked position.

To operate the "lock-out" function the handle 8 is pulled outwardly from the door 2. This causes detent device 82 to act against camming surface 42 so that an adequate pulling force must be applied to handle 8 to overcome the spring or resilient force against the cam surface 42. This tends to prevent accidental operation of the "lock-out" function.

As shaft 10 is pulled out by handle 8, protuberances 86 fit into depressions 54 allowing the shaft 10 to continue to be pulled. When detent device 82 reaches the end of cam surface 42 it "snaps" or moves onto downward sloping cam surface 44, effectively, pushing the head portion 50 into full interlocking engagement with the collar 84, which is the "lock-out" position of the complete assembly.

In this "lock-out" position, the protuberances 86 and the depressions 54 are in an interlocking relationship such that the deadbolt can not be operated by key cylinder 4 and key 5. This is the result of member 16 being held stationary by engagement between the shaft 10 and housing 14. The engagement of the shaft 10 with the housing 14 is a result of the head portion 50 of the shaft nesting within the collar 84 of the housing 14 with the depressions 54 engaging the protuberances 86 on the collar.

In the lock-out position, the signal portion 30 of the shaft 10 and indication mechanism 36 becomes visible to the user indicating that the "lock-out" function is in operation and must be disengaged to operate the deadbolt. See FIGS. 11–12.

To disengage the lock-out function, the user simply pushes on handle 8. The same "snapping" camming surface operation will occur when the pushing force overcomes the spring force of detent device 82 on camming surface 44. This will cause the lock-out function to disengage, thereby allowing handle 8 to be rotated which rotates member 16 and moves the deadbolt to the unlock position.

In an alternate embodiment, a person ordinarily skilled in the art would understand that the depressions 54 could be present in the collar 84 and the corresponding protuberances 86 could be present in the head portion 50. It should also be understood that deadbolt manipulation mechanisms are not limited simply to a key cylinder and handle, but may take the form of various mechanical devices, such as, for example a combination dial. Neither is the invention limited to deadbolts or bolts, but can be used with any known locking mechanism.

Figure 19:
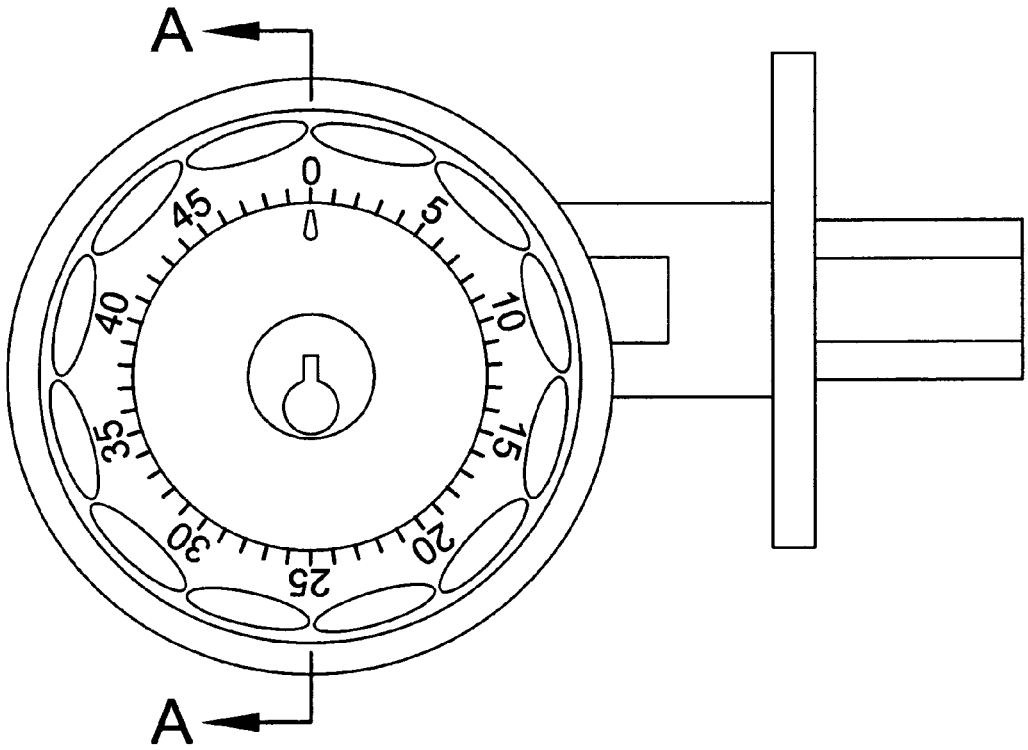
FIG. 19 illustrates a device for operating a locking device that can be operated through the use of a combination dial or a key cylinder.

The invention can be used with any mechanical device that can operate any locking mechanism, including a combination-type mechanical device or a device that can be operated by a combination dial or a key cylinder alternatively and interchangeably. In such a device, a user can operate a locking mechanism, including a deadbolt, by rotating a dial using an authorized numerical combination or by using the key cylinder. Such a device is depicted in FIG. 19.

The invention has been described with reference to the preferred embodiment. Clearly, modifications and alterations will occur to others upon a reading and understanding of this specification. It is intended to include all such modifications and alterations insofar as they come within the scope of the appended claims or the equivalents thereof.

The invention claimed is:

1. A deadbolt mechanism comprising:

(a) a deadbolt;

(b) at least two deadbolt manipulation mechanisms; and (c) a lockout mechanism comprising:

(i) a shaft connecting said at least two deadbolt manipulation mechanisms, said shaft including a head portion including one or more depressions; and (ii) a shaft housing including an opening for receiving said shaft and a collar surrounding at least a portion of said opening;

wherein said head portion of said shaft can be selectively moved into and out of nesting engagement with said collar such that when said head portion is nested within said collar, said one or more depressions engage one or more portions of said collar, thereby preventing rotation of said shaft.

2. The deadbolt mechanism of claim 1 further comprising an indication mechanism located on said shaft, wherein said indication mechanism indicates whether or not said head portion is nested within said collar.

3. A deadbolt mechanism comprising:

a deadbolt;

at least two deadbolt manipulation mechanisms, wherein at least one of said deadbolt manipulation mechanisms is a knob and at least one of said deadbolt manipulation mechanisms includes a locking mechanism;

a shaft connecting said at least two deadbolt manipulation mechanisms, said shaft comprising an indication mechanism and a head portion including a set of depressions; and a shaft housing including an opening for receiving said shaft and a collar, said collar including a set of protuberances;

whereby said set of depressions and said set of protuberances can be selectively placed in an interlocking relationship to prevent operation of said deadbolt and said indication mechanism provides visual indication as to whether or not said set of depressions and said set of protuberances are in interlocking relationship.

4. A deadbolt mechanism comprising:

(a) a deadbolt;

(b) at least two deadbolt manipulation mechanisms; and (c) a lockout mechanism comprising:

(i) a shaft connecting said at least two deadbolt manipulation mechanisms, said shaft including a head portion including one or more depressions; and (ii) a collar including at least one protrusion, said collar being disposed around the shaft;

wherein said head portion of said shaft can be selectively moved into nesting engagement with said collar such that when said head portion is nested within said collar, said one or more depressions engage at least one protrusion of said collar, thereby preventing rotation of said shaft and can be moved such that the head portion is disposed completely outside said collar, thereby allowing rotation of the shaft.

5. The deadbolt mechanism of claim 4 wherein the collar is formed integrally with a door mounting plate.

6. The deadbolt mechanism of claim 4 wherein the head portion is disposed completely within an axial extent of the collar when the head portion is nested within the collar.

7. The deadbolt mechanism of claim 4 wherein the at least one protrusion is integrally formed with the collar and extends radially inward.

8. The deadbolt mechanism of claim 4 wherein the at least one protrusion has a substantially constant cross-section in a direction of an axis of the collar.

9. The deadbolt mechanism of claim 4 wherein the at least one protrusion is integrally formed with the collar and extends along an entire length of the collar.

10. The deadbolt mechanism of claim 4 wherein the one or more depressions extend along an entire length of the head portion of the shaft.

11. A deadbolt mechanism comprising:

(a) a deadbolt;

(b) at least two deadbolt manipulation mechanisms; and (c) a lockout mechanism comprising:

(i) a shaft connecting said at least two deadbolt manipulation mechanisms, said shaft including a head portion including one or more depressions; and (ii) a collar including at least one protrusion that is formed integrally with the collar and extends radially inward from an inner circumferential surface of the collar, said collar being disposed around the shaft;

wherein said head portion of said shaft can be selectively moved into and out of nesting engagement with said collar such that when said head portion is nested within said collar, said one or more depressions engage said at least one integrally formed protrusion of said collar, thereby preventing rotation of said shaft.

12. The deadbolt mechanism of claim 11 wherein the collar is formed integrally with a door mounting plate.

13. The deadbolt mechanism of claim 11 wherein the at least one protrusion has a substantially constant cross-section in a direction of an axis of the collar.

14. The deadbolt mechanism of claim 11 wherein the at least one protrusion extends along an entire length of the collar.

15. The deadbolt mechanism of claim 11 wherein the one or more depressions extend along an entire length of the head portion of the shaft.

16. A deadbolt mechanism comprising:

(a) a deadbolt;

(b) at least two deadbolt manipulation mechanisms; and (c) a lockout mechanism comprising:

(i) a shaft connecting said at least two deadbolt manipulation mechanisms, said shaft including a head portion including one or more depressions; and (ii) a collar including at least one protrusion that is formed integrally with the collar and has a substantially constant cross-section in a direction of an axis of the collar, said collar being disposed around the shaft;

wherein said head portion of said shaft can be selectively moved into and out of nesting engagement with said collar such that when said head portion is nested within said collar, said one or more depressions engage said at least one integrally formed protrusion of said collar, thereby preventing rotation of said shaft.

17. The deadbolt mechanism of claim 16 wherein the collar is formed integrally with a door mounting plate.

18. The deadbolt mechanism of claim 16 wherein the at least one protrusion extends along an entire length of the collar.

19. The deadholt mechanism of claim 16 wherein the one or more depressions extend along an entire length of the head portion of the shaft.

20. A deadbolt mechanism comprising:

(a) a deadbolt;

(b) at least two deadbolt manipulation mechanisms; and (c) a lockout mechanism comprising:

(i) a shaft connecting said at least two deadbolt manipulation mechanisms, said shaft including a head portion including one or more depressions; and (ii) a collar including at least one protrusion that is formed integrally with the collar and extends along an entire length of the collar, said collar being disposed around the shaft;

wherein said head portion of said shaft can be selectively moved into and out of nesting engagement with said collar such that when said head portion is nested within said collar, said one or more depressions engage said at least one integrally formed protrusion of said collar, thereby preventing rotation of said shaft.

21. The deadbolt mechanism of claim 20 wherein the collar is formed integrally with a door mounting plate.

22. The deadbolt mechanism of claim 20 wherein the one or more depressions extend along an entire length of the head portion of the shaft.

23. A deadbolt mechanism comprising:

(a) a deadbolt;

(b) at least two deadbolt manipulation mechanisms; and (c) a lockout mechanism comprising:

(i) a shaft connecting said at least two deadbolt manipulation mechanisms, said shaft including a head portion including one or more depressions wherein the one or more depressions that extend along an entire length of the head portion; and (ii) a collar including at least one protrusion, said collar being disposed around the shaft;

wherein said head portion of said shaft can be selectively moved into and out of nesting engagement with said collar such that when said head portion is nested within said collar, said one or more depressions engage said at least one protrusion of said collar, thereby preventing rotation of said shaft.

24. The deadbolt mechanism of claim 23 wherein the collar is formed integrally with a door mounting plate.

* * * * *